United States Patent [19]

Nagai et al.

[11] Patent Number: 4,967,635

[45] **Date of Patent: * Nov. 6, 1990**

[54] ELECTRONIC MUSICAL INSTRUMENT

[75] Inventors: Yohei Nagai; Shimaji Okamoto, both of Hamamatsu, Japan

[73] Assignee: Yamaha Corporation, Hamamatsu, Japan

[ * ] Notice: The portion of the term of this patent subsequent to Aug. 16, 2005 has been disclaimed.

[21] Appl. No.: 186,462

[22] Filed: Apr. 26, 1988

Related U.S. Application Data

[63] Continuation of Ser. No. 783,092, Oct. 2, 1985, which is a continuation of Ser. No. 507,948, Jun. 24, 1983, which is a continuation of Ser. No. 303,174, Sep. 17, 1981, abandoned, which is a continuation of Ser. No. 64,917, Aug. 8, 1979, Pat. No. 4,383,462, which is a continuation of Ser. No. 784,941, Apr. 5, 1977, abandoned.

[30] Foreign Application Priority Data

Apr. 6, 1976 [JP] Japan ..... 51-38466

[51] Int. Cl.[5] ..... G10H 7/00

[52] U.S. Cl. ..... 84/605; 84/626; 84/627; 84/701

[58] Field of Search ..... 84/1.01, 1.26, 1.19, 84/605, 626, 627, 701

[56] References Cited

U.S. PATENT DOCUMENTS

| | | | |
|---|---|---|---|
| 2,940,351 | 6/1960 | Chamberlin . | |
| 2,946,252 | 7/1960 | Clark, Jr. . | |
| 3,515,792 | 6/1970 | Deutsch . | |
| 3,539,701 | 11/1970 | Milde . | |
| 3,610,799 | 10/1971 | Watson . | |
| 3,610,805 | 10/1971 | Watson et al. . | |
| 3,652,776 | 3/1972 | Milde, Jr. | 84/1.18 |
| 3,740,450 | 6/1973 | Deutsch . | |
| 3,809,786 | 5/1974 | Deutsch . | |
| 3,816,637 | 6/1974 | Whitefield . | |
| 3,844,379 | 10/1974 | Tomisawa et al. . | |
| 3,854,365 | 12/1974 | Tomisawa et al. | 84/1.24 |
| 3,854,366 | 12/1974 | Deutsch . | |
| 3,913,442 | 10/1975 | Deutsch . | |
| 3,935,783 | 2/1976 | Machanian et al. . | |
| 3,979,996 | 9/1976 | Tomisawa et al. . | |
| 4,109,208 | 8/1978 | Tomisawa et al. . | |
| 4,122,743 | 10/1978 | Tomisawa et al. . | |
| 4,383,462 | 5/1983 | Nagai et al. | 84/1.01 |
| 4,763,553 | 8/1988 | Nagai et al. | 84/1.01 |

FOREIGN PATENT DOCUMENTS

| | | |
|---|---|---|
| 1935306 | 1/1971 | Fed. Rep. of Germany . |
| 2237594 | 2/1973 | Fed. Rep. of Germany . |
| 2523880 | 12/1975 | Fed. Rep. of Germany . |
| 2524062 | 12/1975 | Fed. Rep. of Germany . |
| 50-120823 | 9/1975 | Japan . |
| 50-159902 | 12/1975 | Japan . |
| 51-111326 | 10/1976 | Japan . |

OTHER PUBLICATIONS

"Science", pp. 553–557, Nov. 1, 1963.
"Transistor Technology", pp. 185–197, Apr. 1, 1976.

*Primary Examiner*—Forester W. Isen
*Attorney, Agent, or Firm*—Cushman, Darby & Cushman

[57] ABSTRACT

In an electronic musical instrument of the waveshape memory type including at least one waveshape memory for storing and reproducing sample values of a musical sound wave to be generated, the waveshape memory stores the sample values of the complete waveshape of a musical tone with a shaped envelope.

7 Claims, 7 Drawing Sheets

FIG. 1
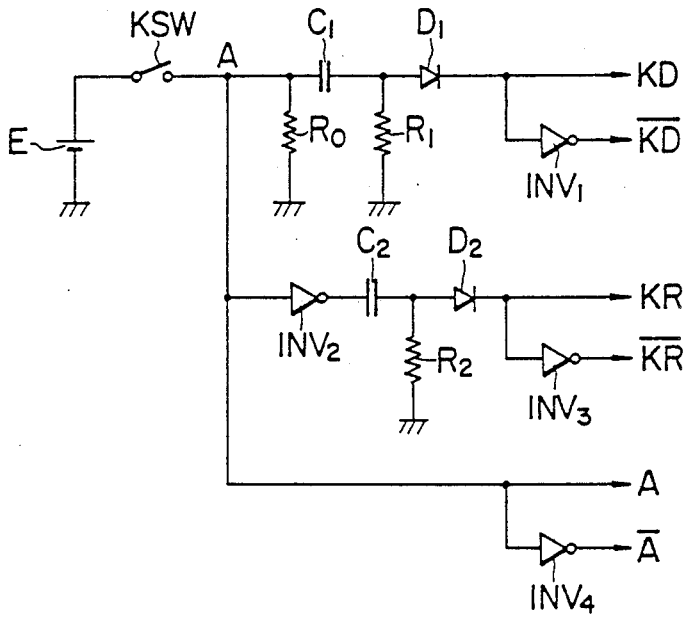
FIG. 2a
FIG. 2b
FIG. 2c
FIG. 2d
FIG. 2e
FIG. 2f
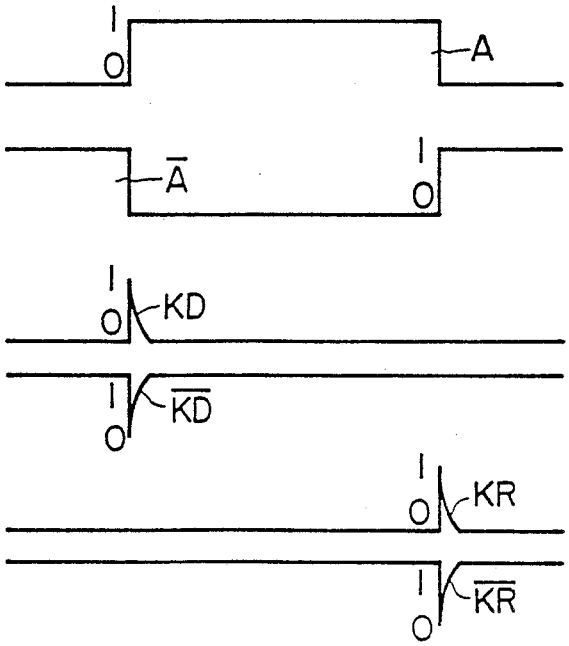

ELECTRONIC MUSICAL INSTRUMENT

This is continuation of application Ser. No. 783,092, filed Oct. 2, 1985, which is a continuation of Ser. No. 507,948 filed June 24, 1983, which was a continuation of Ser. No. 303,174 filed Sep. 17, 1987, now abandoned, which was a continuation of Ser. No. 064,917 filed Aug. 8, 1979, now U.S. Pat. No. 4,383,462 issued May 17, 1983, which was a continuation of Ser. No. 784,941 filed April 5, 1977, now abandoned.

BACKGROUND OF THE INVENTION (a) Field of the invention:

The present invention relates to an electronic musical instrument, and more particularly it pertains to an electronic musical instrument capable of simulating natural sounds by a waveshape memory system.

(b) Description of the prior art:

Heretofore, many attempts have been made to electronically or electrically reproduce, by electronic musical instruments, natural sounds existing in the natural world and to produce arbitrary artificial sounds. For example, according to one proposed method, original sounds are recorded on magnetic tapes or the like and the recorded sound information is reproduced by mechanically driving the magnetic tapes selectively upon depressions of keys in an electronic musical instrument. Such method, therefore, is not purely electronic. Accordingly, it is difficult to quickly and faithfully follow up the depressions of keys which are performed at a high speed. Furthermore, in such a case, the rise and fall of a produced musical sound become very unnatural due to the mechanical nature of the tape feed.

There are many problems which are encountered in electronically synthesizing natural sounds. Generally speaking, a natural sound is formed of an extremely complicated combination of such factors as amplitude, frequency and phase. Moreover, all these factors vary with time. Therefore, it has been practically impossible to satisfy all such conditions, i.e. it has not been possible to reproduce all the complicated variations. Thus, the attempts to simulate natural sounds existing in the natural world have not succeeded at least in practice.

SUMMARY OF THE INVENTION

The present invention has been worked out in view of the circumstances described above, and an object thereof is to provide an electronic musical instrument capable of perfectly simulating natural sounds existing in the natural world and further capable of generating a variety of artificial sounds as musical sounds.

In order to accomplish this object according to the present invention, the electronic musical instrument comprises a waveshape memory system, and the information of the complete waveshape ranging from the attack to the decay of each musical sound to be produced is preliminarily stored in the waveshape memory. The output of the waveshape memory is directly utilized as a musical sound signal. Furthermore, according to the present invention, a plurality of such waveshape memories are used. At least one of such waveshape memories stores the information of part of the complete waveshape ranging from the attack to the decay of each musical sound to be produced, and another waveshape memory or memories store information of all or part of the remainder of the complete waveshape, and these waveshape memories are successively and/or repeatedly read out.

Here, the term "waveshape memory system" refers to a system for storing sample values of a waveshape of a musical sound to be produced and for reading out these sample values at a selected speed (such system is stated in for example, U.S. Pat. No. 3,515,792). In the prior art waveshape memory, however, the waveshape memory system stores the waveshape of a standard sound in one period without its envelope information added. The envelope shaping is performed by separately generating the envelope information and multiplying it with the waveshape signals which are repeatedly read out from the memory.

In this specification, the term "complete waveshape" of a musical sound refers to a tone waveshape which is afforded with an envelope shaping, whereas the term "tone waveshape" refers to a tone waveshape without the envelope shaping. That is, according to the present invention, a waveshape memory stores the "complete" waveshape of the whole or a part of the whole one musical tone. For saving the number of bits of the memory means, it is preferable to store the "complete" waveshape for only a part of a musical tone. From this point of view, the "complete" waveshape in the attacking period of a musical tone may be stored in a memory and the waveshape of the remainder period of the musical tone may be formed by repeatedly reading out a standard waveshape from another memory which independnetly has memorized the standard waveshape and multiplying the signal repeatedly read out from said another memory by a sustaining envelope and/or a decaying envelope to constitute the above-said complete waveshape for the remaining period. Such arrangement is particularly suitable for generating percussive tones such as the sounds of a piano.

BRIEF DESCRIPTION OF THE DRAWINGS

FIG. 1 is a circuit diagram of a keyboard device to be used in the embodiments of the present invention.

FIGS. 2*a* to 2*f* show waveshapes at various outputs of the device of FIG. 1.

DETAILED DESCRIPTION OF THE PREFERRED EMBODIMENTS

Throughout the embodiments to be described hereinbelow, similar keyboard devices are used. Therefore, description will be first made with respect to the keyboard device.

FIG. 1 shows a keyboard circuit for an individual key. Similar circuits are also provided for other keys of the keyboard. In the figure, a key switch KSW switches the power supply from a voltage source E to a circuit for generating various key operation signals. A differentiation circuit is formed with resistors $R_0$ and $R_1$ and a capacitor $C_1$. Another differentiation circuit is formed with a capacitor $C_2$ and a resistor $R_2$. Diodes $D_1$ and $D_2$ are used for blocking pulses of negative polarity. Inverters $INV_1$ to $INV_4$ invert the polarity of the input signals.

A point A is grounded through the resistor $R_0$ and connected to the voltage source E through the key switch KSW. The voltage from the voltage source E appears at point A during the key is depressed. Thus, a key depression signal A is generated upon depression of a key as shown in FIG. 2*a*. The inverter $INV_4$ forms an inverted or complimentary key depression signal $\overline{A}$ as shown in FIG. 2*b*. The key depression signal A is differentiated by the differentiation circuit formed with the resistors $R_0$ and $R_1$ and the capacitor $C_1$ to generate a positive and a negative pulse at the times of key depression and key release. The negative pulse signal corresponding to the key release is blocked by the diode $D_1$. Thus, the diode $D_1$ supplies only the key depression pulse signal KD as shown in FIG. 2*c*. The inverter $INV_1$ inverts the polarity of this key depression pulse to generate an inverted or complimentary key depression pulse $\overline{KD}$ as shown in FIG. 2*d*. Further, the key depression signal A is inverted through the inverter $INV_2$ and then differentiated by the differentiation circuit formed of the capacitor $C_2$ and the resistor $R_2$ to generate a negative and positive pulse signal at the times of key depression and key release. The negative pulse corresponding to the key depression is blocked by the diode $D_2$. Thus, the diode $D_2$ provides the key release pulse signal KR as shown in FIG. 2*e*. The inverter $INV_3$ inverts the polarity of this key release pulse to generate the inverted or complimentary key release pulse signal $\overline{KR}$ as shown in FIG. 2*f*. In this way, the keyboard device provides a group of signals upon each key operation.

Description will hereinbelow be made with respect to the embodiments of the present invention. Throughout these embodiments, the circuit shown in the figure represents that for a single key. Similar circuit structure may be adopted for each key in the keyboard or in a part of the keyboard.

EMBODIMENT 1

Figure 3:
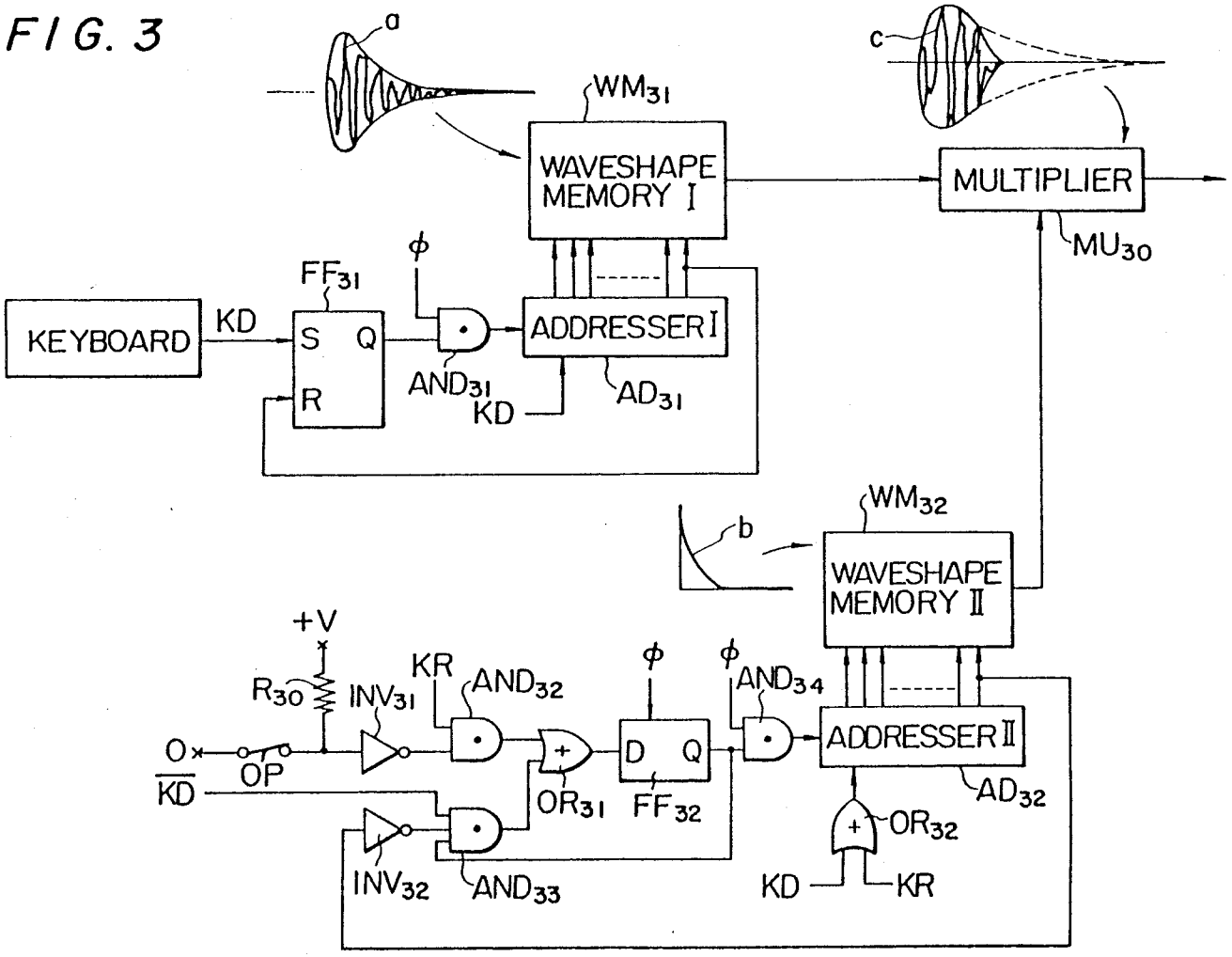
FIG. 3 is a block diagram of an electronic musical instrument according to the first embodiment of the present invention.

FIG. 3 shows the first embodiment of the electronic musical instrument adapted for providing percussive tones. In this embodiment, the "complete" waveshape for whole one musical tone is stored in and read out from a memory, which may provide all the attack, sustain and decay envelopes when the key is depressed and kept depressed. Another memory is provided for damping the musical tone upon release of the key while not depressing the damper pedal.

The waveshape memories $WM_{31}$ and $WM_{32}$ are respectively addressed by addressers $AD_{31}$ and $AD_{32}$. The first waveshape memory $WM_{31}$ stores therein the complete waveshape from the attack to the decay of a tone (curve a), while the second waveshape memory $WM_{32}$ stores a damping envelope waveshape (curve b). Therefore, when the read-out of the second waveshape memory $WM_{32}$ is initiated, for example by the release of the key while reading out the first waveshape memory $WM_{31}$, waveshape signals which is read out from the respective waveshape memories $WM_{31}$ and $WM_{32}$ are multiplied in a multiplier unit $MU_{30}$ to provide a resultant waveshape of which the decay becomes faster from the time of the key release as shown by curve c. Accordingly, when the percussive tone of a sound of a piano or the like is stored in the first waveshape memory $WM_{31}$ and a suitable decay envelope waveshape in the second waveshape memory $WM_{32}$, a very excellent simulation of the percussive tone is obtained. Here, the memory contents in the two waveshape memories $WM_{31}$ and $WM_{32}$ may be arbitrarily altered in conformity with the nature of an intended sound.

Now, the details of the arrangement of FIG. 3 will be described along with the operation thereof.

When a key depression pulse KD as shown in FIG. 2*c* is generated by a key depressing operation as described in connection with FIG. 1, a flip-flop $FF_{31}$ is set to continuously generate a Q output. Then, clock pulses $\phi$ of a predetermined frequency are directly transmitted through an AND circuit $AND_{31}$ to the addresser $AD_{31}$, which sequentially generate a pulse at their each output, one at a time, to thereby address the waveshape memory $WM_{31}$ to read out the waveshape which is stored therein. When the addresser $AD_{31}$ generates the last bit output, the flip-flop $FF_{31}$ is re-set, and the reading-out of the waveshape memory $WM_{31}$ terminates.

Figure 4:
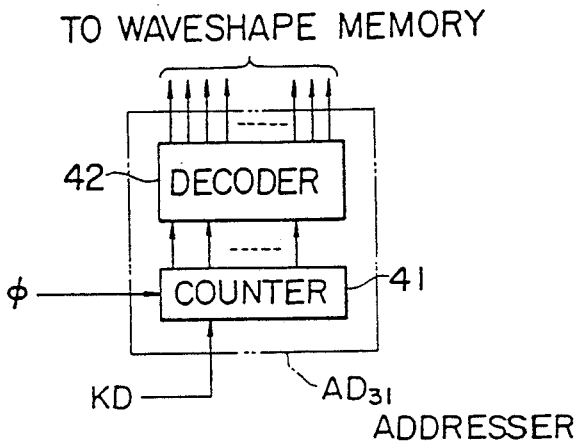
FIGS. 4 and 5 are block diagrams of an addresser and a self-holding flip-flop loop for elucidating the essential portions of the embodiment of FIG. 3.

An example of the addresser $AD_{31}$ is shown in FIG. 4, which comprises a counter 41 and a decoder 42. The content of the addresser $AD_{31}$, i.e. the content of the counter 41, is cleared by the key depression pulse KD before the initiation of counting. Other addressers referred to in this specification may have similar structures. The waveshape memory $WM_{31}$ may be formed with a ROM or the like. Other waveshape memories referred to in this specification may have similar structures.

Now, let us assume that the key releasing operation is conducted while the first waveshape memory $WM_{31}$ is being read out and that a damper pedal is released and an associated damper switch DP is closed for effecting an abrupt decay of the sound. When the damper switch DP is open, a voltage +V is applied to an inverter $INV_{31}$ through a resistance $R_{30}$. When the damper switch DP is closed, the ground (zero) potential O is applied to the inverter $INV_{31}$ and accordingly the output of the inverter $INV_{31}$ becomes "1". Upon the key release with the damper switch DP closed, a key release pulse KR as shown in FIG. 2*e* is applied to and allowed to transmit through an AND circuit $AND_{32}$ and an OR circuit $OR_{31}$ to a D-type flip-flop $FF_{32}$. Thus, the flip-flop $FF_{32}$ provides a Q output. The Q output is delivered to AND circuits $AND_{33}$ and $AND_{34}$. The inverted key depression pulse $\overline{KD}$ which is applied to the AND circuit $AND_{33}$ is "1" when the key has been released. Furthermore, the output of an inverter $INV_{32}$ which is applied with the final bit output of the addresser $AD_{32}$ is also applied to the AND circuit $AND_{33}$ and is "1" since there is yet no output at the final bit of the addresser $AD_{32}$. Accordingly, the AND circuit $AND_{33}$ satisfies the AND condition and feeds the Q output of the flip-flop $FF_{32}$ back to the input of the same flip-flop $FF_{32}$ through the OR circuit $OR_{31}$. Therefore, the flip-flop $FF_{32}$ is self-held.

The self-held flip-flop $FF_{32}$ permits the clock pulses $\phi$ of the predetermined frequency to pass through an AND circuit $AND_{34}$ to enter into the addresser $AD_{32}$. The addresser $AD_{32}$ addresses the waveshape memory $WM_{32}$ storing the decaying envelope to read out the sample values of the memory content. Here, when an output is generated at the final bit of the addresser $AD_{32}$, the output of the inverter $INV_{32}$ becomes "0" and the AND condition for the AND circuit $AND_{33}$ is destroyed. Therefore, the self-holding of the flip-flop $FF_{32}$ is released, and the drive of the addresser is terminated. In order to prepare for the key release and a re-depression of the key, the addresser $AD_{32}$ has its content cleared by either of the key depression pulse KD and the key release pulse KR through the OR circuit $OR_{32}$.

In the manner described above, according to this embodiment, a rapidly decaying envelope is given on the waveshape which is read out from the first waveshape memory $WM_{31}$, i.e. multiplied in the multiplier unit $MU_{30}$ by the closure of the damper switch DP and the key release. Thus, the so-called damper effect is afforded by which the volume of the sound decreases quickly after the release of the key.

Figure 5:
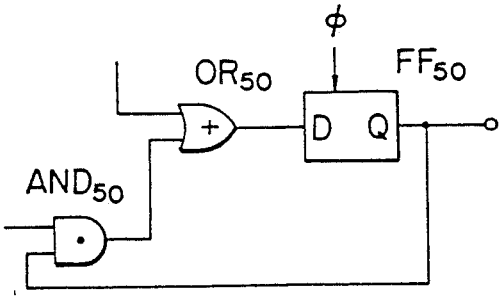

FIG. 5 shows a self-holding flip-flop circuit in which an output of a D-type flip-flop $FF_{50}$ can be self-held by a loop including an OR circuit $OR_{50}$ and an AND circuit $AND_{50}$ in the manner as described above. Since such self-holding circuit will also be used in the ensuing embodiments, detailed explanation thereof will be omitted.

EMBODIMENT 2

Figure 6:
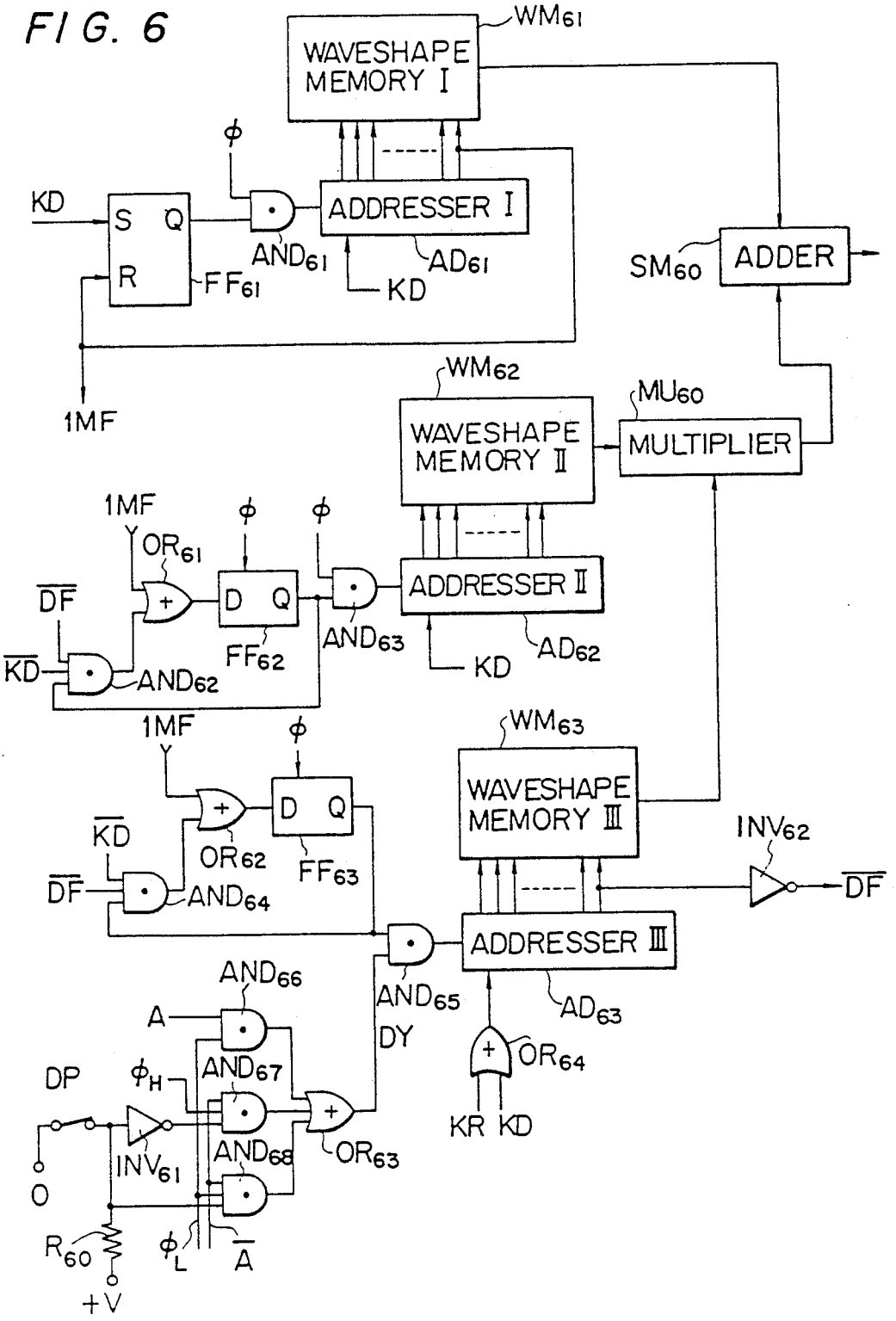
FIGS. 6, 7 and 8 are block diagrams of an electronic musical instrument according to the second, third and fourth embodiments of the present invention, respectively.

FIG. 6 shows a second embodiment of the present invention, in which the "complete" waveshape is stored in a memory only for the attacking period of a musical tone. Although the embodiment is suitable to obtain a percussive tone similar to the first embodiment, the use thereof is not restricted to the generation of such percussive tones.

This embodiment uses three kinds of waveshape memories $WM_{61}$, $WM_{62}$ and $WM_{63}$ which are respectively addressed by addressers $AD_{61}$, $AD_{62}$ and $AD_{63}$. The first waveshape memory $WM_{61}$ stores therein the complete waveshape in the attack period, the second waveshape memory $WM_{62}$ stores at least one fundamental period of a musical tone waveshape, and the third waveshape memory $WM_{63}$ stores an envelope waveshape ranging from the sustain to the decay, which envelope shape follows the attack. Therefore, when the envelope shaping is performed while reading out the second waveshape memory $WM_{62}$ following the reading-out of the first waveshape memory $WM_{61}$, the musical sound having similar effects as those of the first embodiment can be produced using simpler memories than those in the first embodiment. Here, the memory content of the third waveshape memory $WM_{63}$ may not include the sustain envelope.

Now, the construction and the operation of this embodiment will be made apparent through the following description of the processes of forming a musical sound.

The arrangement of a flip-flop $FF_{61}$, an AND circuit $AND_{61}$ and the addresser $AD_{61}$ for addressing sampling values in the waveshape memory $WM_{61}$ upon arrival of a key depression pulse KD is similar to the arrangement for addressing the first waveshape memory $WM_{31}$ in the first embodiment. Thus, the description thereof is omitted here. When the readingout of the first waveshape memory $WM_{61}$ which stores the complete waveshape of the attack period terminates and the final bit output of the addresser $AD_{61}$ is generated, this final bit output signal re-sets the flip-flop $FF_{61}$. The final bit output is also utilized as a signal 1MF for driving the addressers $AD_{62}$ and $AD_{63}$ which address the second and third waveshape memories $WM_{62}$ and $WM_{63}$.

A D-type flip-flop $FF_{62}$ is set through an OR circuit $OR_{61}$ by the signal 1MF. The output of the flip-flop $FF_{62}$ is self-held when the AND condition of an AND circuit $AND_{62}$ is satisfied. The flip-flop $FF_{62}$ supplies clock pulses $\phi$ of a predetermined frequency to the addresser $AD_{62}$ through an AND circuit $AND_{63}$. Thus, the addresser $AD_{62}$ is driven to read out the content of the waveshape memory $WM_{62}$. The AND condition for the AND circuit $AND_{62}$ for generating an output "1" is that the inverted key depression signal $\overline{KD}$ is "1" and also the inverted output $\overline{DF}$ (inverted by an inverter $INV_{62}$) of the final bit output DF of the addresser $AD_{63}$ assigned for addressing the third waveshape memory $WM_{63}$ is "1". Therefore, unless the reading-out of the third waveshape memory $WM_{63}$ has terminated after the depression of the key, the AND condition of the AND circuit $AND_{62}$ holds, and the flip-flop $FF_{62}$ self-holds.

A D-type flip-flop $FF_{63}$ for driving the addresser $AD_{63}$ is self-held by the loop of an OR circuit $OR_{62}$ and an AND circuit $AND_{64}$ under the similar conditions for the self-holding of the flip-flop $FF_{62}$.

The addresser $AD_{63}$ for addressing the third waveshape memory $WM_{63}$ is supplied with a drive signal when the AND condition of AND circuit $AND_{65}$ is satisfied. One input of the AND circuit $AND_{65}$ is the output of the self-holding flip-flop $FF_{63}$, and the other is a decay instruction signal DY which is formed in the following manner.

There are three kinds of decay instruction signal DY. Firstly, when a key is being depressed and when a key depression signal A (FIG. 2*a*) is generated, the AND condition of an AND circuit $AND_{66}$ is satisfied by a clock signal $\phi_L$ of a comparatively long period of clock synchronization. In consequence, the addresser $AD_{63}$ addresses the third waveshape memory $WM_{63}$ at a comparatively slow speed corresponding to the clock signal $\phi_L$. Accordingly, the decay envelope waveshape which is comparatively gentle is multiplied with the waveshape which is read out from the second waveshape memory $WM_{62}$ in a multiplier unit $MU_{60}$. The resultant waveshape is supplied through an adder $SM_{60}$.

Secondly, when the key is not depressed and the inverter key depression signal $\overline{A}$ (FIG. 2*b*) is generated and when the damper pedal is depressed and the pedal switch DP is opened, the AND condition of an AND circuit $AND_{68}$ is satisfied, and the comparatively gentle decay envelope is given to the musical sound by the same clock signal $\phi_L$ as in the first case.

Thirdly, when an output of an inverter $INV_{61}$ becomes "1" upon the release of the damper pedal to close the pedal switch DP and when the key is not depressed and the inverted key depression signal $\overline{A}$ is generated, the AND condition of an AND circuit $AND_{67}$ is satisfied, and a clock signal $\phi_H$ of a comparatively short period is transferred through an OR circuit $OR_{63}$ to the addresser $AD_{63}$. In consequence, the addresser $AD_{63}$ addresses the third waveshape memory $WM_{63}$ at a comparatively high speed. Accordingly, a rapidly decaying envelope waveshape is given in the multiplier unit $MU_{60}$ to the waveshape which is read out from the second waveshape memory $WM_{62}$. Thus, succeeding to the read-out output of the first waveshape memory $WM_{61}$, the above-described waveshape is delivered from the adder $SM_{60}$. Here, the third addresser $AD_{63}$ is cleared by either one of the key depression pulse KD and the key release pulse KR supplied through an OR circuit $OR_{64}$ as in the first embodiment.

As will be understood from the above, according to the second embodiment, the whole waveshape of the attack part is read out from the first waveshape memory $WM_{61}$ immediately after the depression of the key. Following the reading-out of the waveshape in the attack part, the second waveshape memory $WM_{62}$ is repeatedly read out. To these repeatedly read-out waveshapes, (a) the gentle decay envelope is multiplied irrespective of the depression or release of the key if the damper switch DP is opened or (b) the rapid decay envelope is multiplied immediately after the release of the key when the damper switch DP is closed.

EMBODIMENT 3

Figure 7:
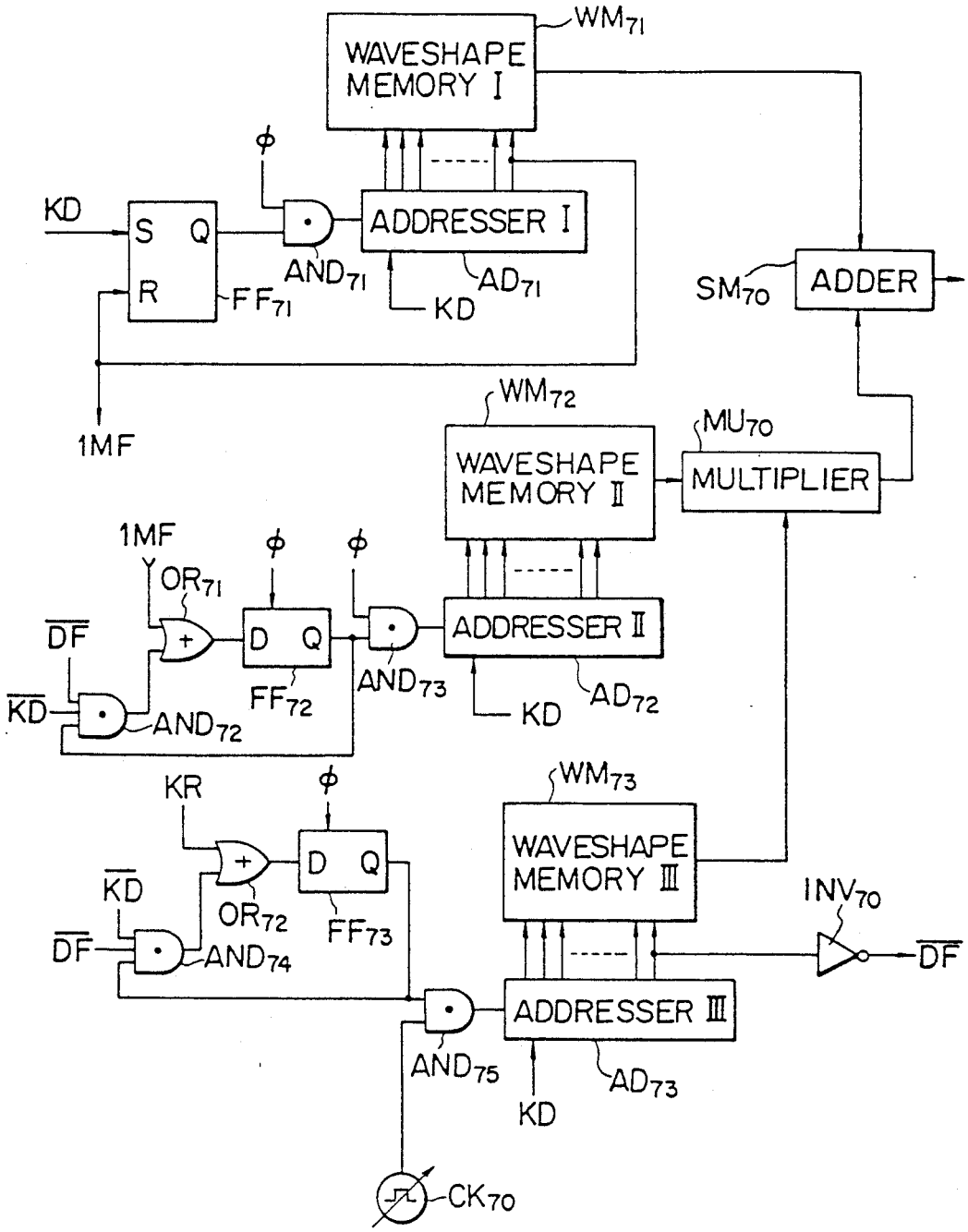

FIG. 7 shows a third embodiment of the present invention in which a tone waveshape is caused to decay off without using a damper pedal. As can be seen in the figure, this embodiment may be regarded as a modification of the second embodiment.

This embodiment comprises three kinds of waveshape memories $WM_{71}$, $WM_{72}$ and $WM_{73}$ which are respectively addressed by addressers $AD_{71}$, $AD_{72}$ and $AD_{73}$. The first waveshape memory $WM_{71}$ stores the complete waveshape in the attack period, the second waveshape memory $WM_{72}$ stores at least one period of the tone waveshape, and the third waveshape memory $WM_{73}$ stores an envelope waveshape from the sustain to the decay, which envelope shape follows the attack. Therefore, after reading out the first waveshape memory $WM_{71}$, the second waveshape memory $WM_{72}$ is subsequently read out repeatedly, and the envelope waveshape which is read out from the third waveshape memory $WM_{73}$ in correspondence with the release of the key is multiplied in a multiplier unit $MU_{70}$ to the output of the second waveshape memory $WM_{72}$. Thus, a musical sound signal is provided from an adder $SM_{70}$.

Now, the construction and the operation of this embodiment will be made apparent through the following description of the processes for forming a musical tone. The arrangement of a flip-flop $FF_{71}$, an AND circuit $AND_{71}$ and an addresser $AD_{71}$ for addressing sampling values in the waveshape memory $WM_{61}$ upon arrival of a key depression pulse KD is similar to those in the first and the second embodiments. The final bit output signal of the addresser $AD_{71}$ is used as the re-set signal for the flip-flop $FF_{71}$ and also as the start signal 1MF for the addresser $AD_{72}$ which addresses the second waveshape memory $WM_{72}$. These points are similar to those in the second embodiment, and will be apparent without further description.

In performing the reading-out of the second waveshape memory $WM_{72}$, a D-type flip-flop $FF_{72}$ is set through an OR circuit $OR_{71}$ by the signal 1MF, and the output of the flip-flop $FF_{72}$ is self-held when the AND condition for an AND circuit $AND_{72}$ is satisfied. The addresser $AD_{72}$ is driven through an AND circuit $AND_{73}$ by clock pulses $\phi$ of a predetermined period to read out the content of the second waveshape memory $WM_{72}$. Here, as is the case with the AND circuit $AND_{62}$ of the second embodiment, the inputs of the AND circuit $AND_{72}$ are formed with the inverted key depression pulse $\overline{KD}$ and the inverted output $\overline{DF}$ of the final bit output DF of the addresser $AD_{73}$ as is obtained by an inverted $INV_{70}$.

The reading-out of the third waveshape memory $WM_{73}$ is performed in the following manner. Namely, a D-type flip-flop $FF_{73}$ is set through an OR circuit $OR_{72}$ by a key release pulse KR. The output of the flip-flop $FF_{73}$ is self-held when the AND condition for an AND circuit $AND_{74}$ is satisfied. A clock signal $CK_{70}$ drives the addresser $AD_{73}$ through an AND circuit $AND_{75}$. Namely, when the key is released, a key release pulse KR is generated and it sets the flip-flop $FF_{73}$ through an OR circuit $OR_{72}$. Since the input conditions of the AND circuit $AND_{74}$ are similar to those for the AND circuit $AND_{72}$ associated with the second waveshape memory $WM_{72}$, the output of the flip-flop $FF_{73}$ is self-held. Thus, as one input of the AND circuit $AND_{75}$ continuously receives a "1" signal, the AND condition for the AND circuit $AND_{75}$ is satisfied when the other input receives the clock signal $CK_{70}$. The addresser $AD_{73}$ performs addressing at the period determined by the clock signal $CK_{70}$, and the content of the waveshape memory $WM_{73}$ is read out. As will be understood from the above, the clock signal $CK_{70}$ determines the decay speed and it may be arranged to be arbitrarily selectable. When the addresser $AD_{73}$ provides the last bit output, the decay is terminated. The final bit output is inverted in the inverter $INV_{70}$ to form the decay-termination instruction signal $\overline{DF}$. The decay-termination instruction signal $\overline{DF}$ supplies "0" to each one input of the AND circuits $AND_{72}$ and $AND_{74}$. Therefore, the AND circuits $AND_{72}$ and $AND_{74}$ lose the AND condition and hence the inputs of the second and third addressers $AD_{72}$ and $AD_{73}$ disappear. Consequently, the reading-out of the second and the third waveshape memories $WM_{72}$ and $WM_{73}$ is terminated.

In summary, according to the third embodiment, the complete waveshape in the attack period is read out from the first waveshape memory $WM_{71}$ and is outputted through the adder $SM_{70}$ immediately after the depression of the key, and subsequently, the content of the second waveshape memory $WM_{72}$ storing the tone waveshape devoid of the envelope shaping is repeatedly read out to form the sustain part of the tone. Without the key releasing operation, the output of the second waveshape memory $WM_{72}$ continues to be delivered through the multiplier unit $MU_{70}$ and the adder $SM_{70}$. When the key release pulse KR is generated by the key releasing operation, the decaying envelope which is stored in and read out from the third waveshape memory $WM_{73}$ is multiplied in the multiplier unit $MU_{70}$ to the waveshape which is read out from the second waveshape memory $WM_{72}$. Thus, the musical sound is allowed to decay and extinguish.

In this manner, according to the third embodiment, the attack waveshape is formed by the use of the first waveshape memory $WM_{71}$, the sustain waveshape by the second waveshape memory $WM_{72}$, and the decay waveshape by the combination of the second and third waveshape memories $WM_{72}$ and $WM_{73}$.

EMBODIMENT 4

Figure 8:
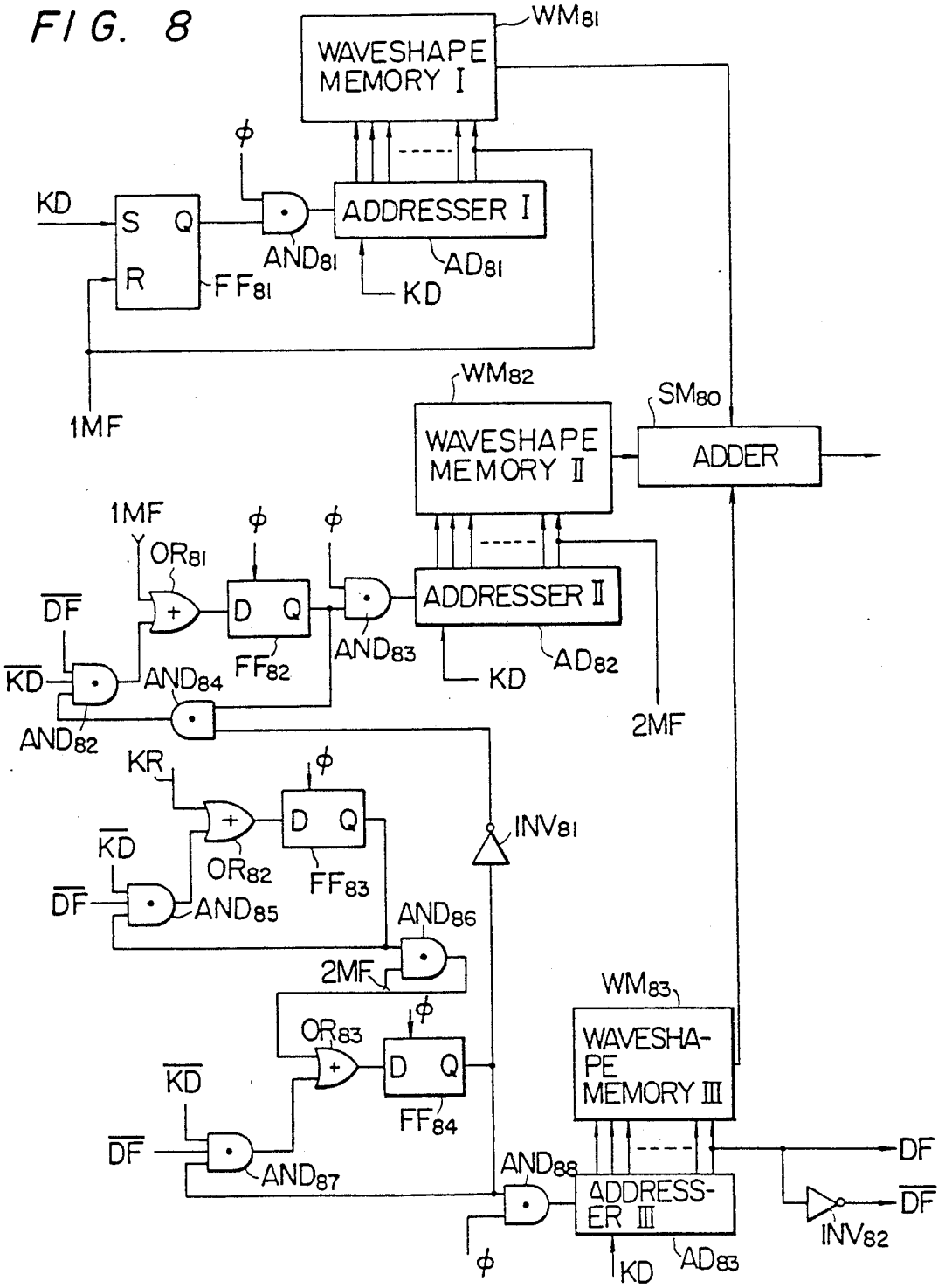

FIG. 8 shows a fourth embodiment of the present invention in which the complete waveshapes in the attack and the decay of a musical sound are read out from waveshape memories.

This embodiment also utilize three waveshape memories $WM_{81}$, $WM_{82}$ and $WM_{83}$ which are respectively addressed by addressers $AD_{81}$, $AD_{82}$ and $AD_{83}$. The first waveshape memory $WM_{81}$ stores the complete waveshape in the attack of the tone, the second waveshape memory $WM_{82}$ stores a tone waveshape corresponding to one fundamental period or integer times thereof, and the third waveshape memory $WM_{83}$ stores the complete waveshape in the decay period of the tone. Therefore, subsequent to the reading-out of the attack waveshape from the first waveshape memory $WM_{81}$, the sustain waveshape is repeatedly read out from the second waveshape memory $WM_{82}$ in conformity with the continuation of the sustain. Subsequent to the termination of the reading-out of the second waveshape memory $WM_{82}$, the decaying waveshape is read out from the third waveshape memory $WM_{83}$. Thus, a musical tone signal is suitably generated through an adder $SM_{80}$.

Now, description will be made with respect to the processes for forming a musical tone signal while clarifying the construction and the operation of the arrangement.

The arrangement of a flip-flop $FF_{81}$, an AND circuit $AND_{81}$ and the addresser $AD_{81}$ addresses the first waveshape memory $WM_{81}$ upon arrival of the key depression pulse KD. The final bit output signal of the addresser $AD_{81}$ serves as the re-set signal for the flip-flop $FF_{81}$ and also as the start signal of the addresser $AD_{82}$ addressing the second waveshape memory $WM_{82}$. These points are similar to those described in the second and third embodiments, and they are not repeatedly explained here.

When the reading-out of the complete waveshape in the attack period from the first waveshape memory $WM_{81}$ terminates, a D-type flip-flop $FF_{82}$ is set through an OR circuit $OR_{81}$ by the signal 1MF, and the output of the flip-flop $FF_{82}$ is self-held when the AND condition for an AND circuit $AND_{82}$ is satisfied. The addresser $AD_{83}$ is driven by clock pulses $\phi$ of a predetermined period through an AND circuit $AND_{83}$ to read out the content of the waveshape memory $WM_{82}$. Here, as are the case with the AND circuits $AND_{62}$ and $AND_{72}$ of the second and third embodiments, the input signals of the AND circuit $AND_{82}$ comprise the inverted key depression pulse $\overline{KD}$ and the inverted output $\overline{DF}$ of the final bit output DF of the third addresser $AD_{83}$ formed by an inverter $INV_{82}$. The output of an AND circuit $AND_{84}$ is used as an input of the AND circuit $AND_{82}$. Inputs of the AND circuit $AND_{84}$ comprise a Q output of the flip-flop $FF_{82}$ and an output of an inverter $INV_{81}$. As will be described later, the output of the inverter $INV_{81}$ is "1" under the depression of the key. Therefore, if the Q output of the flip-flop $FF_{82}$ is provided, the AND condition for the AND circuit $AND_{84}$ and accordingly the AND circuit $AND_{82}$ is satisfied.

In this manner, the reading-out of the second waveshape memory $WM_{82}$ is performed. The reading-out is repeated until the key is released. In order to read out the second waveshape memory $WM_{82}$, the addresser $AD_{82}$ transmits a final bit output signal 2MF to an AND circuit $AND_{86}$ at every cycle of addressing. As will be described below, insofar as the key releasing operation is not conducted, the AND condition for the AND circuit $AND_{86}$ is not satisfied.

Next, when a key release pulse KR is generated in correspondence with a key releasing operation, a D-type flip-flop $FF_{83}$ is set through an OR circuit $OR_{82}$, and the output of the flip-flop $FF_{83}$ is self-held when the AND condition for an AND circuit $AND_{85}$ is satisfied. The AND circuit $AND_{85}$ has input signals similar to those of the AND circuit $AND_{82}$. Thus, one input of the AND circuit $AND_{86}$ becomes "1". When the signal 2MF which is the other input of the AND circuit $AND_{86}$ arrives, the AND condition for the AND circuit $AND_{86}$ is satisfied. Consequently, the AND circuit $AND_{86}$ provides an output, which sets a D-type flip-flop $FF_{84}$ through an OR circuit $OR_{83}$. The set output of the flip-flop $FF_{84}$ forms one of the input signals of an AND circuit $AND_{87}$ which has input signals similar to those of the AND circuit $AND_{85}$. The AND circuit $AND_{87}$ and an OR circuit $OR_{83}$ form a loop with the flip-flop $FF_{84}$ to self-hold the flip-flop $FF_{84}$. On the other hand, the set output of the flip-flop $FF_{84}$ changes one of the input conditions of the AND circuit $AND_{84}$ to "0" through the inverter $INV_{81}$. Therefore, the AND condition for the AND circuit $AND_{84}$ and accordingly the AND circuit $AND_{82}$ is destroyed. The self-holding of the flip-flop $FF_{82}$ is released and the reading-out of the second waveshape memory $WM_{82}$ is stopped. As will be apparent from the above explanation, there may be a possibility that the reading-out of the second waveshape memory $WM_{82}$ continues for some period after the generation of the key release pulse KR (although such time period is of no problem in the auditory sense of the tone). This is attributed to the fact that, in general, the generation of the key release pulse KR and the generation of the final bit output signal 2MF of the addresser $AD_{82}$ are not simultaneous. Moreover, the output of the second waveshape memory $WM_{82}$ and that of the third waveshape memory $WM_{83}$ need be continuous. It is therefore intended to address the third waveshape memory $WM_{83}$ after the second waveshape memory $WM_{82}$ has been infallibly addressed to the last.

The Q output of the flip-flop $FF_{84}$ as has served to stop the readout of the second waveshape memory $WM_{82}$ drives the addresser $AD_{83}$ through an AND circuit $AND_{88}$ by the clock pulses of the predetermined period. Then, the content of the third waveshape memory $WM_{83}$ is read out. It has been previously stated that the third waveshape memory $WM_{83}$ stores the complete waveshape in the decay period of the tone instead of only a decaying envelope shape. Upon termination of the readingout from the third waveshape memory $WM_{83}$, the inverted output $\overline{DF}$ of the final bit output of the addresser $AD_{83}$ is generated. Therefore, each one input of the AND circuits $AND_{82}$, $AND_{85}$ and $AND_{87}$ becomes "0" without fail, and the flip-flop $FF_{82}$, $FF_{83}$ and $FF_{84}$ become ready for the next key depression.

According to the fourth embodiment described above, the complete waveshape in the attack is read out from the first waveshape memory $WM_{81}$ and is outputted through the adder $SM_{80}$ immediately after the depression of the key. The tone waveshape in the sustain is subsequently read out and outputted from the second waveshape memory $WM_{82}$ through the adder $SM_{80}$ by the signal which is indicative of the read-out termination of the first waveshape memory $WM_{81}$, and lastly, at the occurrence of the key release, the reading-out of the second waveshape memory $WM_{82}$ is stopped at the next occurrence of the final address, and the complete waveshape in the decay is read out from the third waveshape memory $WM_{83}$ and is outputted through the adder $SM_{80}$, thereby completing the formation of the entire tone signal.

MODIFICATION

Figure 9:
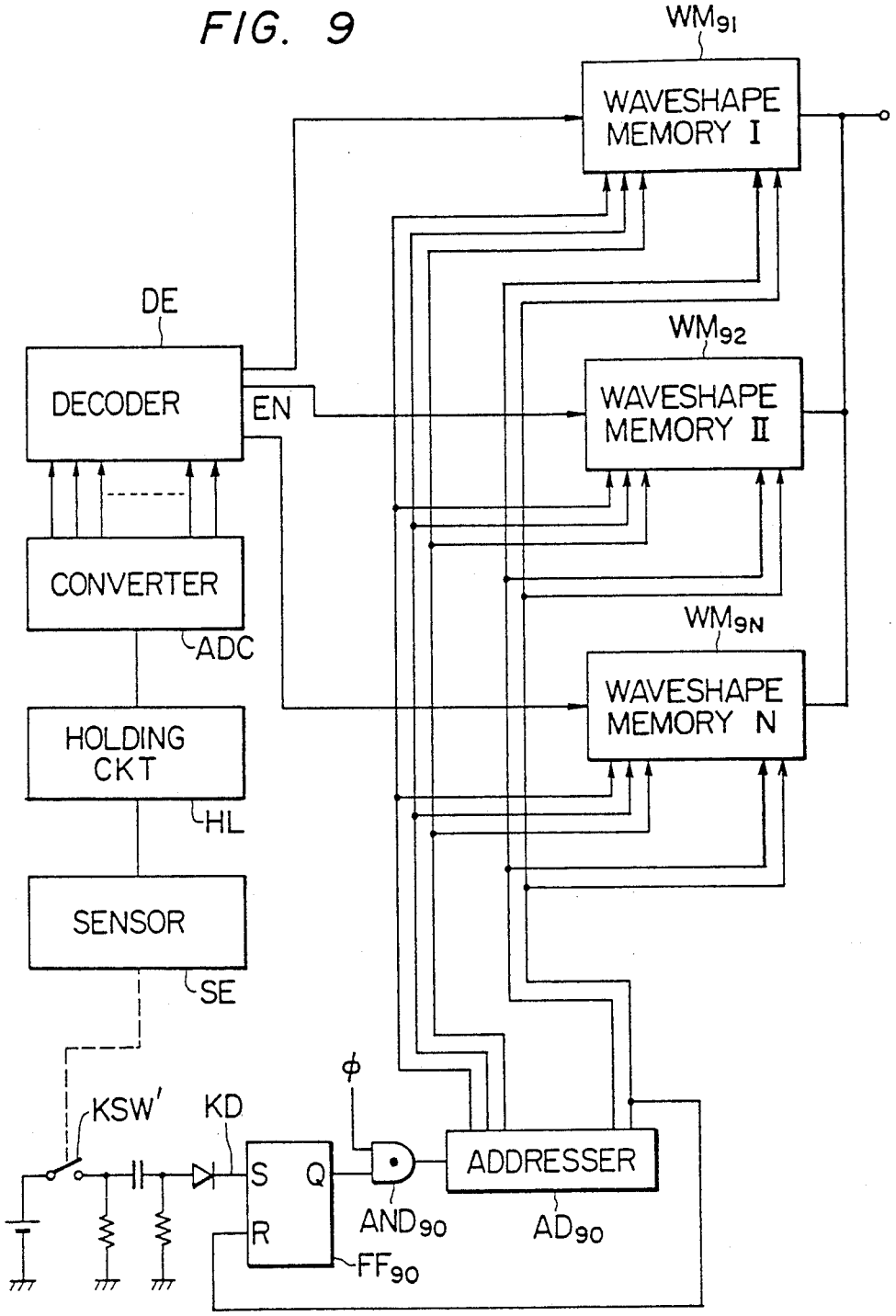
FIG. 9 is a block diagram of an electronic musical instrument according to a modified embodiment of the present invention.

In the embodiments described above, the touch response of the keying operation is not taken into consideration, and a musical tone which varies according to the strength of the key depression, etc. cannot be produced. FIG. 9 shows a modified embodiment which takes this point into account. Adaptation of this modification to the attack waveshape which forms a part of each of the foregoing embodiments enables variations in the musical tone in conformity with the key operation such as the key depression speed or its pressure. The operation and the construction of this modification will be described hereinbelow.

The key depression pulse KD is generated by manipulating a key switch KSW'. By the pulse KD, a flip-flop $FF_{90}$ is set to provide a Q output. Upon the provision of the Q output, clock pulses $\phi$ of a fixed period are supplied to an addresser $AD_{90}$ through an AND circuit $AND_{90}$. These points are similar to those in the addressing of the first waveshape memory in each of the foregoing embodiments.

According to this modification, however, the depressed state of the key switch KSW' is sensed by a sensor SE and converted to an electric signal. The peak value of the key depression strength is held by a holding circuit HL, whereupon the held value is converted to a digital value by an A-D converter ADC. The converted digital value is a read-out signal for a decoder DE. Depending upon the value, the decoder DE generates an "enable" signal EN which instructs one of waveshape memories $WM_{91}$–$WM_{9N}$ to be read out. The waveshape memory which is selected and supplied with the "enable" signal EN from the decoder DE stores a complete waveshape in the attack, in conformity with the particular key touch. Such a selected complete waveshape is read out by the addresser $AD_{90}$.

Here, the sensor SE may be formed of any one of the various known types. For example, an electrically conductive material whose resistance value varies with the strength of the key depression may be combined with the key. Regarding the holding circuit HL, any one of a variety of known sample hold circuits can be employed.

According to the present invention, at least one of the waveshape memories is arranged to store the complete waveshape of at least part of a musical tone as described above, whereby an electronic musical instrument can easily simulate various natural sounds and generate various artificial sounds as musical sounds.

We claim:

1. An electronic musical instrument of a waveshape memory reading type comprising:

means for producing key depression signals each indicative of a command of a specific musical sound;

means for sensing depression state values for each said key depression signal, possible ones of said depression state values being parameters from the group consisting of a depression speed of producing said musical sound and a depression pressure of producing said musical sound;

a plurality of waveshape memories of a random access addressed type, each for storing wave sample data decisive of a plurality of discrete amplitude sample values for a waveshape at respective addresses of the memory, said waveshapes stored in said memories being different from one memory to others;

an addresser, connected to said waveshape memories and to said producing means, for addressing said waveshape memories at a speed determined in response to said key depression signals to produce a tone signal representing the designated musical sounds; and means for selecting different predetermined ones of said waveshape memories based on said depression state value, thereby producing musical sounds which vary in response to said depression state value.

2. A musical instrument as in claim 1 wherein said waveshape determined by said wave sample data includes plural cycles of vibration which constitute only an attack portion of a sound exhibiting sound factors which vary with time.

3. An electronic musical instrument of a waveshape memory reading type comprising:

means for producing key depression and release signals, each indicative of a start and end respectively of an operation of a key in a keyboard, and designating a musical sound;

a waveshape memory of a random access addressed type, for storing wave sample data indicative of a plurality of discrete amplitude sample values of a waveshape at respective addresses of the memory, said waveshape memory storing the wave sample data for a first waveshape which includes a plurality of cycles of vibration, each cycle having its own shape independent of other cycles and which exhibits a predetermined characteristic defining a musical tone frequency when read out at a speed, said plurality of cycles defining at least a plurality of cycles of an attack portion of a tone, said waveshape memory further storing the wave sample data for a second waveshape which includes at least one cycle of vibration defining a sustain portion of a tone when read out repeatedly;

an addresser connected to said waveshape memory and to said producing means for addressing said waveshape memory at a speed determined in response to said key depression signals, to produce an attack portion of a tone and subsequently thereto a sustain portion of said tone; and envelope imparting means connected to said waveshape memory and to said keyboard means for imparting a decay envelope to the tone produced from said waveshape memory upon receipt of said key release signal.

4. An electronic musical instrument according to claim 3, further comprising damper control means, connected to said envelope imparting means for controlling said envelope imparting means, to impart a gradual decay envelope to the tone produced from said waveshape memory upon receipt of said key release signal when said damper control means designates a non-damped mode, and to impart a quick decay envelope to the tone produced from said waveshape memory upon receipt of said key release signal when said damper control means indicates a damped mode.

5. An instrument as in claim 4, wherein said predetermined characteristic is one of a) pitch and b) frequency.

6. An electronic musical instrument of a waveshape memory reading type comprising:

means for producing key depression and release signals each indicative of a start and end of an operation of each key in a keyboard and designating a musical sound;

a waveshape memory of a random-access addressed type, for storing wave sample data indicative of plurality of discrete amplitude sample values at respective addresses of the memory, said waveshape memory storing a plurality of serial cycles of a waveshape of a tone from the beginning of its attack portion to the beginning of its decay portion;

an addresser connected to said waveshape memory and to said producing means for addressing the waveshape memory at a speed determined in response to the key depression signals, thereby producing a tone signal representing the designated musical sound; and envelope imparting means connected to said waveshape memory and said producing means for imparting a decay envelope to the tone produced from said waveshape memory upon receipt of said key release signal.

7. An electronic musical instrument according to claim 6, further comprising a damper ontrol means connected to said envelope imparting means for controlling said envelope imparting means to impart a gradual decay envelope to the tone produced from said waveshape memory upon receipt of said key release signal when said damper control means designates a non-damped mode, and to impart a quick decay envelope to the tone produced from said waveshape memory upon receipt of said key release signal when said damper control means designates a damped mode.

* * * * *